US006279252B1

(12) United States Patent
Pozzobon et al.

(10) Patent No.: US 6,279,252 B1
(45) Date of Patent: Aug. 28, 2001

(54) SUPPORT DEVICE, PARTICULARLY FOR SHOES

(75) Inventors: Alessandro Pozzobon, Paderno di Ponzano Veneto; Stefano Soligo, Montebelluna, both of (IT)

(73) Assignee: Benetton Group S.p.A., Ponzano Veneto (IT)

( * ) Notice: Subject to any disclaimer, the term of this patent is extended or adjusted under 35 U.S.C. 154(b) by 0 days.

(21) Appl. No.: 09/482,346

(22) Filed: Jan. 14, 2000

(30) Foreign Application Priority Data

Jan. 8, 1999 (IT) ..... TV99A0005

(51) Int. Cl.[7] ..... A43B 5/04
(52) U.S. Cl. ..... 36/117.3; 36/119.1; 36/89
(58) Field of Search ..... 36/117.3, 117.1, 36/119.1

(56) References Cited

U.S. PATENT DOCUMENTS 3,801,119 * 4/1974 Andre ..... 36/117.3
4,949,479 * 8/1990 Ottieri ..... 36/117.3
4,979,760 * 12/1990 Derrah ..... 36/117.3
5,596,820 * 1/1997 Edauw et al. ..... 36/119.1

FOREIGN PATENT DOCUMENTS

U- 29806184 6/1998 (DE) .
A-0634115 1/1995 (EP) .
A- 0821890 2/1998 (EP) .
A- 2626189 7/1989 (FR) .
A- 2641703 7/1990 (FR) .

* cited by examiner

*Primary Examiner*—Paul T. Sewell
*Assistant Examiner*—Troy Arnold
(74) *Attorney, Agent, or Firm*—Guido Modiano; Albert Josif; Daniel O'Byrne

(57) ABSTRACT

A support device, for shoes to be associated with a sports implement such as a ski, a roller skate or an ice skate, includes a rigid shell which partially surrounds the shoe laterally, to the rear and in a lower region and can be interposed between the shoe and an element for engaging the sports implement, the rigid shell having means for detachable locking to the shoe.

14 Claims, 4 Drawing Sheets

SUPPORT DEVICE, PARTICULARLY FOR SHOES

BACKGROUND OF THE INVENTION

The present invention relates to a support particularly for shoes which are associable with a sport implement such as a ski, a roller skate or an ice skate.

It is known that a ski marketed by the company Salomon SA and designated by the trade-name "Snowblade" is currently commercially available; such ski is characterized by a very limited length, approximately one meter, and by a binding which is composed of a base which can be associated in the upper region of the ski and substantially has a first resting region and a second resting region for the heel and tip of a ski boot.

The base has a first front metallic loop at the first region and a second rear metallic loop at the second region.

A lever is rotatably associated at said second loop and is adapted to lock the tip of the boot at the base after arranging the first loop at a heel region of the boot.

A rigid boot, designated by the trade-name "Edition 1", is in fact marketed together with this type of ski by the same company Salomon SA: the use of such boot with the related ski requires the presence, in the heel and tip region, of adapted seats for the first loop, the second loop and the lever, and the boot must be highly rigid in order to provide optimum transmission of forces to the ski.

Likewise, a skate with in-line wheels is known which is marketed by the company Rollerblade Inc., by the trade-name "WBS", and is provided with a shoe which can be detachably associated with a wheel supporting frame by means of an engagement device which is similar to the preceding one.

FR-2641703 and DE-29806184 disclose ski bindings of the above described type.

The drawback of above cited prior art is essentially the need, if one wishes to use the ski or skate, to also purchase the particular type of shoe respectively associable with it, which cannot be otherwise used for other sports. As a partial solution to this drawback, this same Applicant filed an Italian utility model application, No. Tv98U000047, which discloses a support for shoes that can be associated with a ski having a base provided with a first front engagement element which comprises a fastening lever and a second rear engagement element, characterized in that it is constituted by a body which surrounds in a rear region part of a conventional trekking or climbing boot and is rigidly coupled to the second engagement element, said body having means for removable locking to the shoe.

Although this solution is undoubtedly valid, some drawbacks are noted, such as less than optimum stability because of the connection to the engagement element, which is rotatably associated with the support of the binding.

It has in fact been noted that during sports practice the weight force that acts on the support of the shoe is transmitted directly at the rear loop of the binding, thus increasing the working stresses for which the loop was designed owing to the increased lever arm.

This causes instability in the coupling to the shoe, to the detriment of the durability of the binding and of the safety of the user.

SUMMARY OF THE INVENTION

The aim of the present invention is to overcome the drawbacks of the cited prior art, by providing a support which allows to use a sports implement, such as a ski of the conventional type or of the above-described type or a roller skate or an ice skate, with shoes which are not specifically meant for such implements and can also be used for normal walking.

An important object of the present invention is to provide a support which allows, during sports practice, to support the shoe in an optimum manner, allowing the user to achieve optimum transmission of all forces to the sports implement.

Another object of the present invention is to provide a support which can be applied to a conventional sports implement without having to modify the system for locking the shoe to the implement.

This aim, these objects and others which will become apparent hereinafter are achieved by a support device, particularly for shoes, characterized in that it comprises a rigid shell which partially surrounds said shoe laterally, to the rear and in a lower region and can be interposed between said shoe and an element for engaging a sports implement, said rigid shell having means for removably locking to said shoe.

BRIEF DESCRIPTION OF THE DRAWINGS

Further characteristics and advantages of the present invention will become apparent from the following detailed description of a particular embodiment thereof, illustrated only by way of non-limitative example in the accompanying drawings, wherein.

DESCRIPTION OF THE PREFERRED EMBODIMENTS

Figure 1:
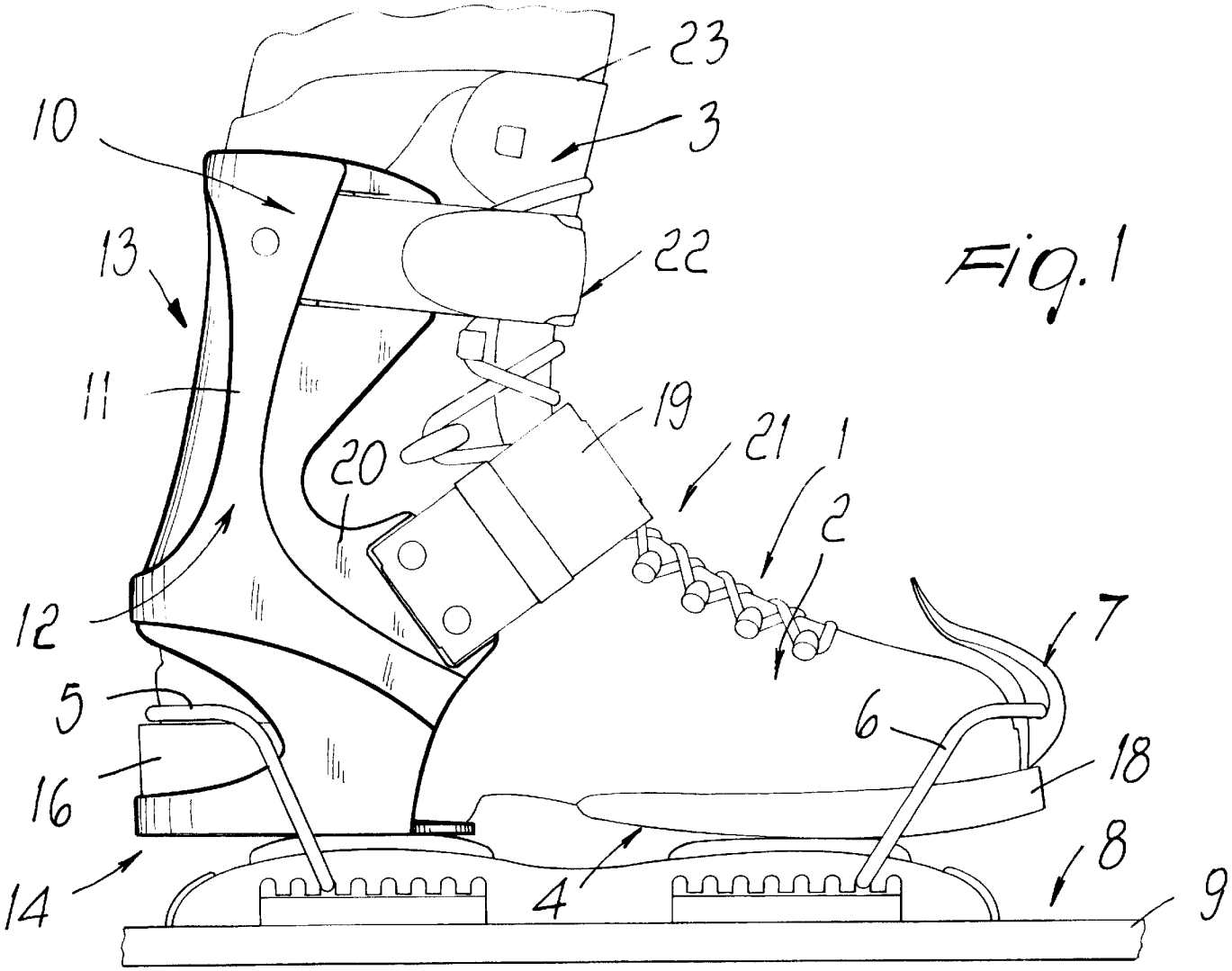
FIG. 1 is a side view of the support applied to a shoe which is in turn associated with a ski.
Figure 2:
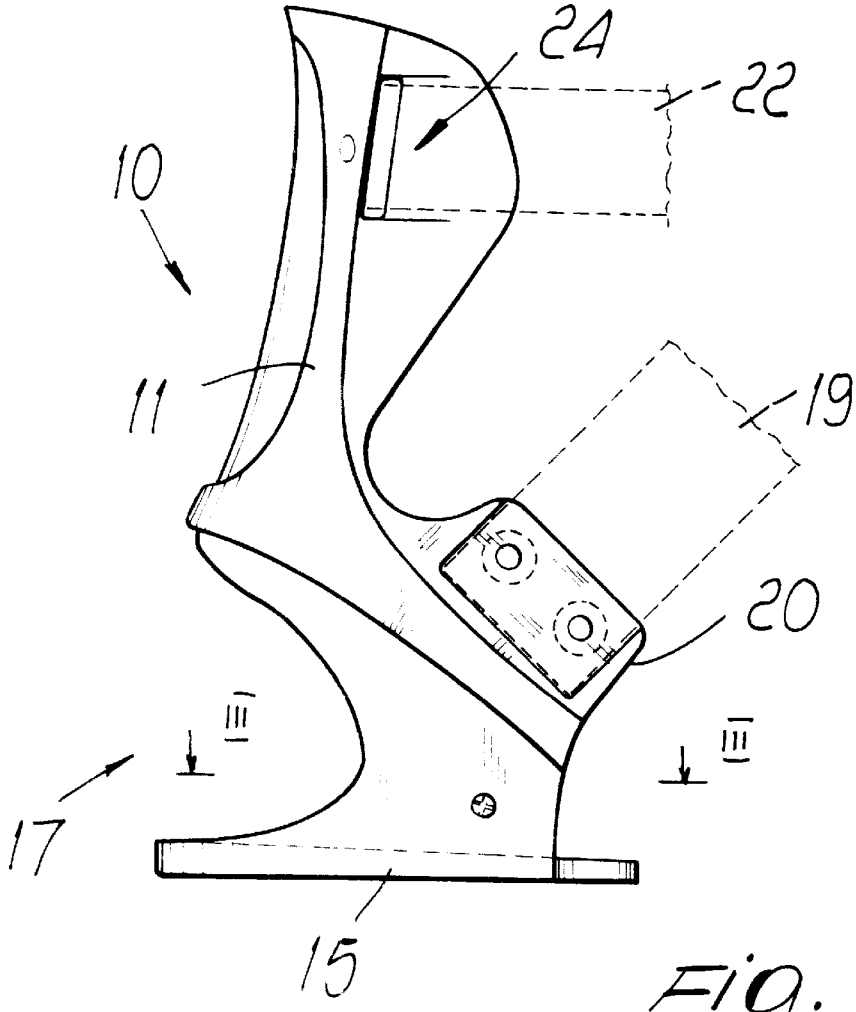
FIG. 2 is a side view of the support.
Figure 3:
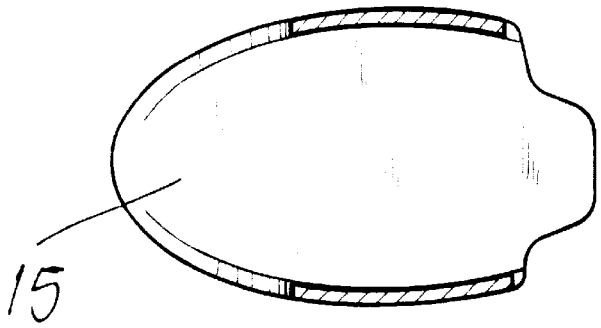
FIG. 3 is a sectional top view of the support, taken along the plane III—III.

With reference to the above figures, the reference numeral 1 designates a shoe of the type commonly used for trekking and/or climbing and accordingly constituted by an upper 2 which has a cuff 3 which lies above the ankle region and below which a sole 4 is associated which has seats which are adapted to accommodate the first engagement element, such as a rear loop 5, and the second engagement element, such as a front loop 6 and a lever 7 of a binding 8 which is associated with a ski 9.

The reference numeral 10 designates the support for the shoe 1; said support is constituted by a rigid shell 11 which partially wraps around the lateral regions 12, the rear region 13 and the lower region 14 of the shoe.

The rigid shell 11 further has a base 15 for supporting the heel 16 of the shoe, which can in turn be arranged at the resting surface of the binding 8.

The rigid shell 11 thus laterally wraps around the ankle and cuff regions and at the same time has, at the rear region 13, an opening 17 which allows access to the rear region of the heel of the shoe on the part of the rear loop 5 in order to allow coupling to the binding.

Such coupling is completed by making the lever 7 associated with the front loop 6 interact at the tip 18 of the shoe.

The support is further constituted by a locking means for detachable locking to the shoe. The locking means comprises, for example, a first strap 19 which is rigidly coupled, at its end, at adapted lateral tabs 20 which protrude from the rigid shell, the first strap wrapping around the upper at the foot instep region 21.

The locking means may also comprise a second strap 22 which wraps around the region of the upper that lies adjacent to the upper perimetric edge 23 and is associated, at its ends, at two seats 24 provided laterally with respect to the rigid shell 11.

The second strap can be of the same kind as the first strap.

This solution therefore allows to associate with a conventional ski having a binding with loops and locking lever, by means of the particular base associated therewith, a conventional trekking or climbing boot while allowing optimum transmission of forces to said ski.

The support is in fact Only locked by the pressure applied by the first loop 5 to the heel 16, providing optimum stability for the shoe during sports practice and leaving the binding 8 free from additional loads with respect to those provided during design and acting during sports activity.

Figure 4:
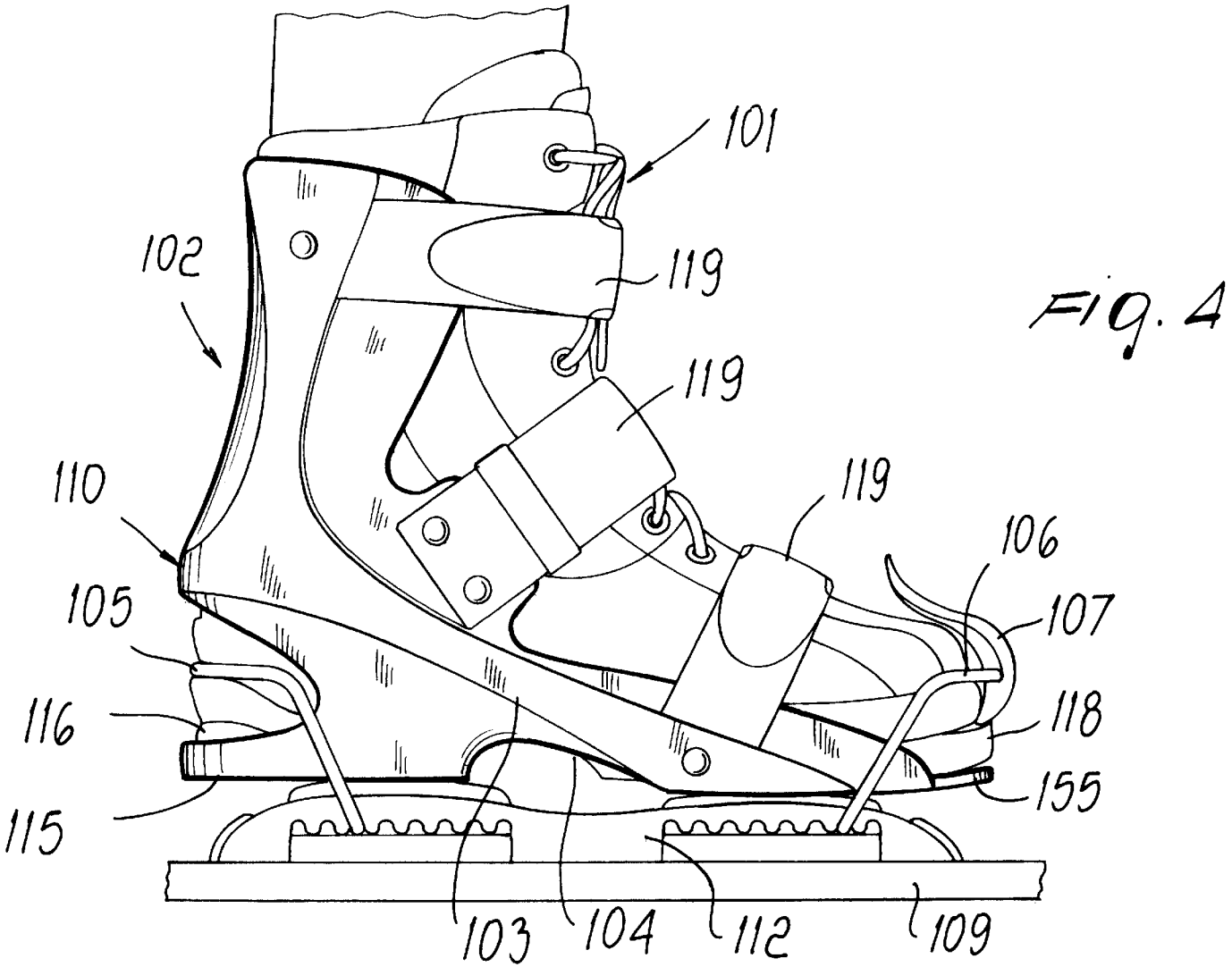
FIG. 4 is a side view of a boot and ski assembly having the support according to a further aspect of the invention.
Figure 5:
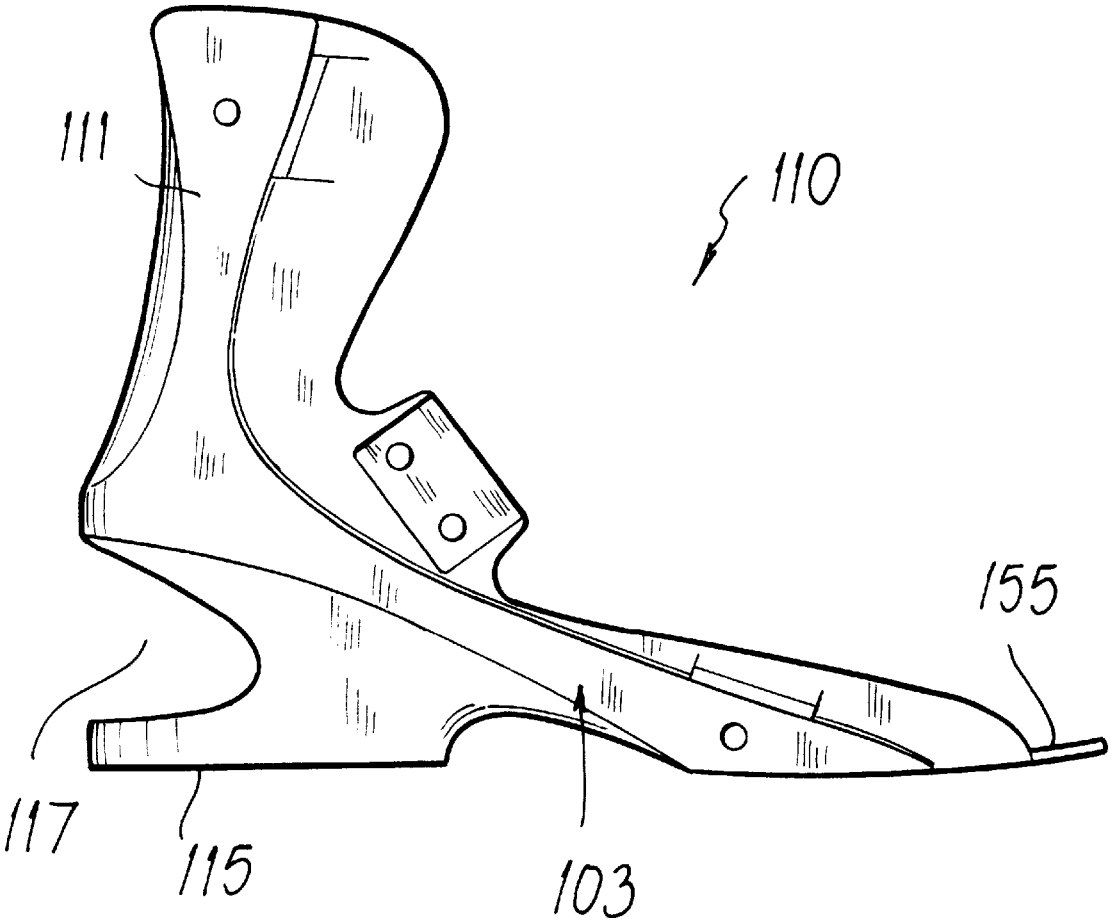
FIG. 5 is a side view of the support of FIG. 4.

FIGS. 4 and 5 illustrate a support 110 according to a further aspect of the invention.

Support 110 can be used to bind a shoe 101 to a sports implement such as a ski 109, as in the above-described embodiment.

Support 110 comprises a shell 111 connected to a first base 115 for supporting the heel 116 of the shoe 101.

The shell 111 has a rear opening 117 allowing access to the heel 116 of the shoe and to the rear loop 105, as described above in the first embodiment.

Shell 111 is also connected to side members 103 extending forward and adapted to support a front base 155.

A front loop 106 is adapted to engage the tip 118 of the shoe and is operated by means of a lever 107.

Straps 119 are provided at the support 110 for locking the shoe 101 therein.

By extending the side members 103 to the front part of the shoe, the present embodiment provides a stiffer support adapted to sports practices that require still a better control of the sports implement.

It has thus been observed that the invention has achieved the intended aim and objects, a support having been provided which allows to associate, at the ski according to the prior art, a trekking or climbing boot, at the same time allowing optimum transmission of forces from the leg and from the foot to the sports implement.

This solution also allows the user to use non-specific shoes, and therefore shoes for uses other than skiing, which also allow normal walking once they have been uncoupled from the ski.

Finally, the proposed solution allows to use conventional systems for locking the shoe to a binding without any intervention or modification thereof.

The application of the invention to sports implements other than skis, such as a roller skate or an ice skate, is of course to be considered fully equivalent and likewise protected by the present application.

The materials and the dimensions that constitute the individual components of the support, and for example the particular types of means for detachably locking the rigid shell to the shoe, may also be the most pertinent according to specific requirements.

The disclosures in Italian Patent Application No. TV99A000005 from which this application claims priority are incorporated herein by reference.

What is claimed is:

1. In combination, a support device supporting a shoe releasably locked to a sports implement by means of a binding engagement element connected to said sports implement, said support device comprising a rigid shell which partially surrounds said shoe laterally, rearwardly and in a lower region such that said support device is interposed between said shoe and a heel resting surface of said binding engagement element, said rigid shell having means for removably locking said shoe, said support device further comprising a rear opening exposing a rear heel region of said shoe, and said binding engagement element comprising a rear retainer releasably engaging said rear heel region of said shoe through said rear opening of said support device.

2. The combination of claim 1, wherein said rigid shell partially wraps around a lateral region, a rear region, and said lower region of said shoe.

3. The combination of claim 1, wherein said rigid shell has a resting base for a heel of said shoe, said resting base being arranged between said heel of said shoe and said heel resting surface of said binding engagement element.

4. The combination of claim 3, wherein said rigid shell laterally wraps around ankle regions of said shoe and around a cuff of said shoe.

5. The combination of claim 1, wherein said means for removably locking to said shoe comprises a first strap which is rigidly coupled, at ends of said first strap, at lateral tabs which protrude from said rigid shell, said first strap wrapping around an upper of said shoe at a foot instep region of said shoe.

6. The combination of claim 5, wherein said means for removably locking to said shoe further comprises a second strap which wraps around a region of said upper that lies adjacent to an upper perimetric edge and is associated, at ends of said second strap, at two seats formed laterally with respect to said rigid shell.

7. The combination of claim 1, wherein said rigid shell comprises side members extending forwardly and supporting a front base, said front base engaging a forward portion of a sole of said shoe.

8. In combination, a support device supporting a shoe releasably locked to a sports implement by means of a binding connected to said sports implement, said support device comprising a rigid shell which partially surrounds said shoe laterally, rearwardly and in a lower region such that said support device is interposed between said shoe and a heel resting surface of said binding, said support device further comprising a rear opening exposing a rear heel region of said shoe, and said binding comprising a rear retainer releasably engaging said rear heel region of said shoe through said rear opening of said support device.

9. The combination of claim 8, wherein said rigid shell comprises a resting base upon which a heel of said shoe rests, said resting base being arranged between said heel of said shoe and said heel resting surface of said binding.

10. The combination of claim 8, further comprising straps interconnecting lateral regions of said rigid shell about said shoe.

11. The combination of claim 8, wherein said rigid shell comprises side members extending forwardly and supporting a front base, said front base engaging a forward portion of a sole of said shoe, and said front base being arranged between said forward portion of said sole of said shoe and a tip resting surface of said binding.

12. A support device for supporting a shoe to be releasably locked to a sports implement by means of a binding connected to said sports implement, said support device comprising a rigid shell configured to partially surround said shoe laterally, rearwardly and in a lower region, when said support device is attached around said shoe, said support device comprising a rear resting base configured for being arranged below and supporting a heel of said shoe when said support device is attached around said shoe, said support device further comprising a rear opening exposing a rear heel region of said shoe such that a rear retainer of a binding may releasably engage said rear heel region of said shoe through said rear opening of said support device when said support device is attached around said shoe and when said shoe is releasably locked to a sports implement by means of the binding.

13. The support device of claim 12, further comprising straps for interconnecting lateral regions of said rigid shell about said shoe when said support device is attached around said shoe.

14. The support device of claim 12, wherein said rigid shell comprises side members extending forwardly and supporting a front resting base configured for being arranged below and supporting a front of said shoe when said support device is attached around said shoe.

* * * * *